US007192346B2

(12) United States Patent
Mathis

(10) Patent No.: US 7,192,346 B2
(45) Date of Patent: Mar. 20, 2007

(54) SYSTEMS AND METHODS FOR SKILL GAME AWARDS

(76) Inventor: Richard M. Mathis, 9773 Lost Colt Cir., Las Vegas, NV (US) 89117

( * ) Notice: Subject to any disclaimer, the term of this patent is extended or adjusted under 35 U.S.C. 154(b) by 417 days.

(21) Appl. No.: 10/125,975

(22) Filed: Apr. 19, 2002

(65) Prior Publication Data

US 2003/0199305 A1 Oct. 23, 2003

(51) Int. Cl.
*A63F 9/24* (2006.01)

(52) U.S. Cl. ..... 463/20; 463/16; 463/23

(58) Field of Classification Search ..... 463/20, 463/16, 23; 273/143 R
See application file for complete search history.

(56) References Cited

U.S. PATENT DOCUMENTS 2,102,532 A 12/1937 Hoke, Jr.
4,618,150 A * 10/1986 Kimura ..... 273/143 R
4,695,053 A * 9/1987 Vazquez et al. ..... 463/18
5,271,628 A * 12/1993 Okada ..... 273/448
6,315,665 B1 * 11/2001 Faith ..... 463/23
6,443,843 B1 * 9/2002 Walker et al. ..... 463/42
2002/0037767 A1 * 3/2002 Ebin ..... 463/25
2003/0003980 A1 * 1/2003 Moody ..... 463/16

FOREIGN PATENT DOCUMENTS

EP 0375190 A2 * 6/1990
GB 2258334 * 2/1993

* cited by examiner

*Primary Examiner*—Corbett B. Coburn
(74) *Attorney, Agent, or Firm*—John Carpenter; Reed Smith, LLP

(57) ABSTRACT

Systems and methods for providing awards to players of skill games where the awards are selected, based upon various factors, prior to playing the skill game. The method includes paying, by the player, a buy-in fee, selecting an award, playing the skill game, and providing the award to a player if the player successfully completes the skill game. The award may be randomly selected, may be selected from a predetermined table of awards, may be adjusted based upon an adjustment pool, may be adjusted based upon the difficulty of the skill game and may be adjusted as play progresses.

78 Claims, 9 Drawing Sheets

SYSTEMS AND METHODS FOR SKILL GAME AWARDS

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to systems and methods for providing awards to players of skill games, and more particularly, to systems and methods for providing awards to players of skill games where the awards are selected, based upon various factors, prior to playing the skill game.

Casino gaming has offered games of chance that can be played upon a machine for many years. Generally and typically said gaming machines employ some method of randomly selecting a game result and presenting it to a player. In the U.S.A. a distinction has been made at the level of the Federal Government as to whether a gaming apparatus generates game outcomes based upon a random selection or whether player skill can influence game outcome to some degree. Games that depend solely upon random selection for generation of game outcomes are classified as Class III and those in which player skill can influence game outcome may be classified as Class II. Said classification is a regulatory matter, but can have very significant economic ramifications. For example, Class III gaming may be relegated to casinos and Indian Tribes that have suitable compacts with state governments. Class III gaming is highly regulated and requires large economic resources in order to comply with regulations in operation and reporting. Class II gaming is, however, currently permitted upon any Indian reservation whether or not an agreement exists with the state in which they are located and reporting and compliance with regulation is considerably simplified.

Skill games may be classified as Class II games, but award to a player must depend to some degree upon player skill. A significant risk to an operator exists if game outcome depends entirely upon player skill as a very skillful player can win every game with disastrous economic results for the operator. If game outcome is made to depend upon skill in such manner that skill level is beyond the bounds of normal human competence then said game outcome essentially becomes a process of random selection, the game is classified as Class III, and is not permitted to be legally operated in a Class II venue. The aforesaid is very important and has been the subject of many court actions.

Several gaming machines that allow skill games to be played currently exist. Most of said gaming machines depend upon a video representation of a spinning reel and require a player to stop certain symbols at a given position in order to accomplish a winning result. The aforesaid method depends upon player skill to influence a game outcome, but in nearly all cases number of symbols is huge and/or speed at which symbols are presented to a player is much greater than can be expected to be processed within even the boundaries of superhuman capabilities. If game outcome can be influenced by normal human capabilities the operator of said game is in danger of losing money. Unfortunately the outcome of a game that uses aforesaid method is more or less a random process and the operator of said game is violating Class II statutes.

A considerable market exists in the U.S. for a method of implementing a Class II gaming device that allows an operator to maintain a profit and player skill to significantly influence award to a player.

SUMMARY OF THE INVENTION

The present invention provides a method of implementing a skill game that employs several well-known principles to one skilled in the art: random selection, mystery pay and reflexive pay determination. Aforesaid principles are well known, but it is the manner and sequence in which they are applied here which makes the present invention unique.

It is established that an operator of a game has a right to a profit that may be gained from players playing said game. This may be termed a management fee and generally and typically is derived from player's losses of games played. In a Class III game the management fee or "operator hold" is derived from player losses based upon stochastic outcome of random game results generated by said Class III gaming apparatus. In a skill game of the present invention, game outcome is determined primarily by player skill, but an award that can be won for successful completion of a skill game is randomly selected prior to game play. A predetermined portion of a player wager may be deducted for management fee.

In the gaming machine industry, an award that is based upon or determined by machine profitability or "machine hold" may be termed a reflexive pay and is generally and typically not permitted due to its use to reduce player win amount. Reflexive pay is normally used in gray area games to forcefully decrease player win until machine hold is greater than or equal to a predetermined amount. In the present invention, reflexive pay is used to increase amount of award to a player and never acts to decrease it. In the present invention, if machine hold is greater than a predetermined amount said excess machine hold is placed in an adjustment pool that can be used to increase player awards. A portion of the excess machine hold is randomly selected and added to a randomly selected award a player can win thus increasing the potential payout amount and keeping machine hold within predetermined boundaries; this process is well known in the art as a mystery pay, but is applied in the present invention to act to adjust machine hold downward and to increase player enjoyment.

The skill game method of the present invention is comprised of numerous processes well known to those skilled in the art. It is the manner in which aforesaid processes are employed that makes the present invention novel and unique. Certain methods of crafting a skill portion of an entire game that are not in normal and general usage will be described later.

An embodiment of the method of the present invention may be summarized generally as follows:

1) Player pays a buy-in amount to allow him to play a game.

2) Apparatus generates a randomly selected award amount for the current game that a player may win by successfully completing a game of skill.
3) Apparatus generates a randomly selected amount that is to be added to the award amount generated in (2) if an amount greater than or equal to said randomly selected amount exists in an adjustment pool. Add the amount so determined to award amount generated in (2) and subtract the amount from the adjustment pool.
4) Display total award amount that can be won by successfully completing a skill game by a player.
5) Begin a game of skill that can be completed successfully by an average person. If said game of skill in (5) is completed successfully by a player, pay the displayed award amount. If the game of skill is not completed successfully, so indicate and player loses amount of buy-in.

A second method of skill game play may be described as:

1) Player pays a buy-in amount to allow him to play a game.
2) Apparatus generates a randomly selected award amount for the current game that a player may win by successfully completing a game of skill.
3) Apparatus determines if amount returned to players over multiple games is less than a predetermined amount. If said amount returned to players is less than said predetermined amount then reduce skill requirements to complete a predetermined game of skill. If the amount returned to players is greater than or equal to the predetermined amount then provide no adjustment to said skill requirements to complete a predetermined game of skill.
4) Display total award amount that can be won by successfully completing a skill game by a player.
5) Begin a game of skill that can be completed successfully by an average person.
6) If said game of skill in (5) is completed successfully by a player, pay the displayed award amount. If the game of skill is not completed successfully, so indicate and player loses amount of buy-in.

Thus, in a broad sense, the present invention provides a method of playing a skill game by at least one player. The method includes paying, by the player, a buy-in fee and selecting an award. The player plays the skill game and is provided the award if they successfully complete the skill game.

A skill game comprises a gaming apparatus that comprises means for a player to buy into a game with anticipation that he can successfully complete a game of skill, means for generating and displaying game progress and outcome and means for paying a predetermined award to a player based upon results of game outcome. Means for generating and displaying game progress generally and typically is a microcomputer running a predetermined program that algorithmically realizes a method previously outlined. Said algorithmic process may comprise means for accepting a current player buy-in, generating an award amount for said current buy-in that a player can win upon successful completion of a skill game, generating a secondary amount from an adjustment pool and adding to the award amount generated, displaying a sum of the previously calculated award amount and said secondary amount, and beginning a game of skill that may be successfully completed by an average person. The gaming apparatus comprises means for evaluation of successful completion of said game of skill, comprises means for displaying results of said evaluation, and comprises means for payment of a previously displayed award due a player upon satisfactory completion of the game of skill.

The method described above is different from general and typical skill games in that an award amount is calculated for each buy-in from which a management fee may be subtracted. Generally and typically an award amount is predetermined and fixed for completion of a skill game and said skill game is made to be extremely difficult to successfully complete. The skill game described in the present invention does not rely upon a player not being able to successfully complete the game of skill and therefore does not require that the game be nearly impossible to complete successfully by a person of average capability. Additionally, if machine hold exceeds a certain threshold amount in the present invention, provision is made to make said threshold amount available to players for awards. The skill game in the present invention can be made reasonably simple for an average player to successfully complete since operator profit is assured by management fee and means of subtracting said fee for each game. Player award is assured by the aforesaid and randomly drawing amounts from the adjustment pool to supplement calculated award amounts for successful completion of each game adds an element of excitement and, additionally, assures that payback to players will always be a guaranteed amount.

DESCRIPTION SPECIFIC EXEMPLARY EMBODIMENTS OF THE INVENTION

Figure 1:
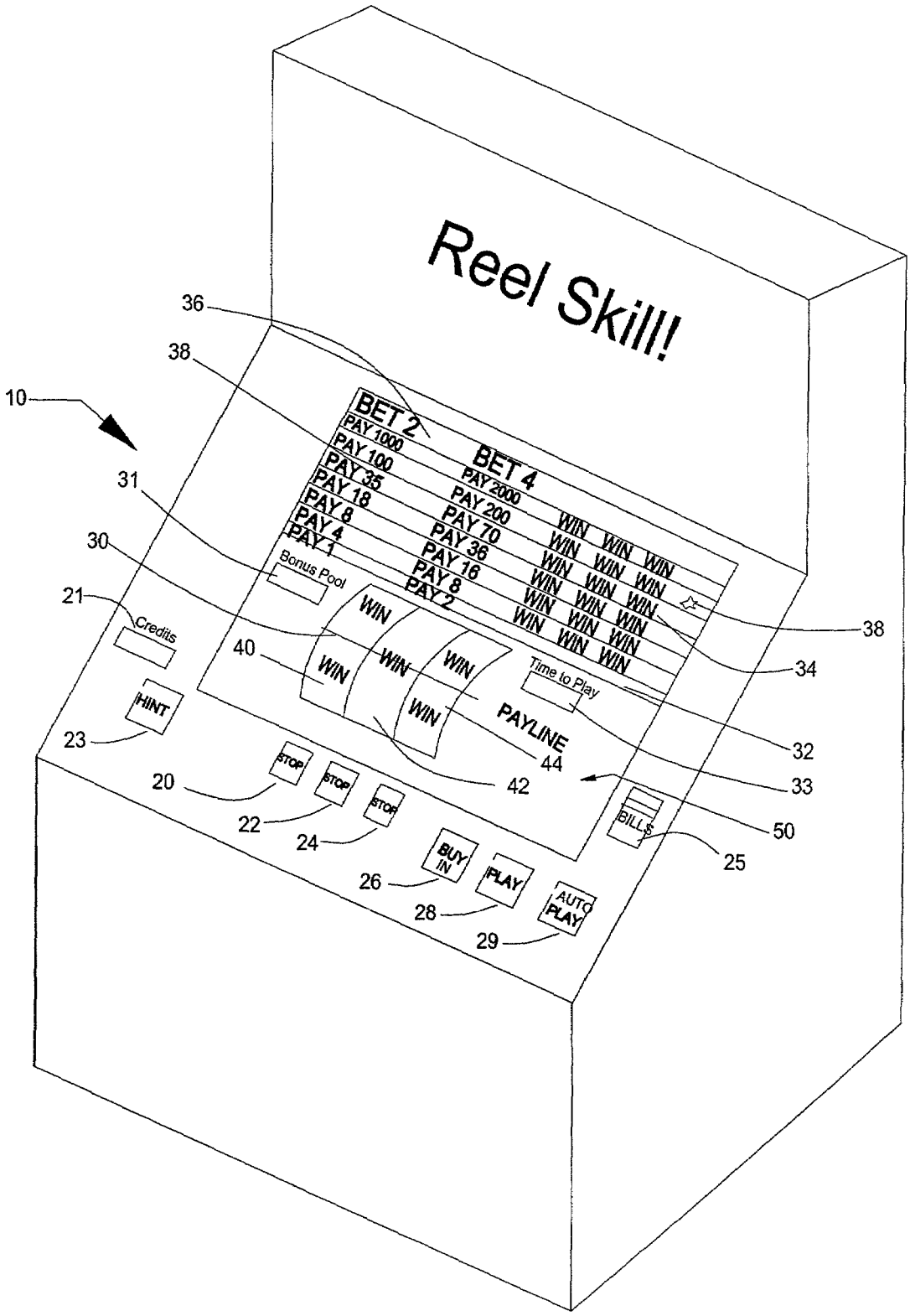
FIG. 1 is a perspective view of a skill game apparatus.

Turning now to the drawings, FIG. 1 shows a perspective view of a gaming machine 10. Said gaming apparatus may be comprised of a game display 50, and means for player interaction with a game played upon the gaming apparatus. Said game display may comprise mechanical or video means of showing game progress and results to a player and may indicate requirement for player decision and input. Generally and typically the gaming apparatus is controlled by a microcomputer running a program to present a particular game to a player. Using FIG. 1 as an example, a player buys credits that may be used to purchase play upon gaming apparatus 10 and said credits that may be used to purchase play are shown to a player upon credit display 21. A player buys a game play by means of pressing button 26 and initiates game play by means of pressing button 28. A management fee is deducted from the amount paid by a player to play a game and an award (in one embodiment, the award is a prize comprising at least one of a gift certificate, meal voucher, and hotel voucher) that said player will win upon successful completion of a game of skill is generated by a random selection algorithm and is shown on pay table 36. In a particular game shown in this example, reels 40, 42 and 44—upon which are superimposed symbols—begin to rotate. Said rotation may be a mechanical rotation or a representation thereof. Successful completion of said game of skill is, in this example, by means of stopping winning symbols superimposed upon the reels in such a manner that said winning symbols are directly beneath the payline 30 and correspond in arrangement to a payline that was previously selected by an algorithm running on a microcomputer, in this example said payline is indicated by icon 38. Successful completion of the game of skill results in a player having credits added to the total 21 and unsuccessful completion of the game of skill results in a player losing the entire amount of his buy in to play of the game.

Figure 2:
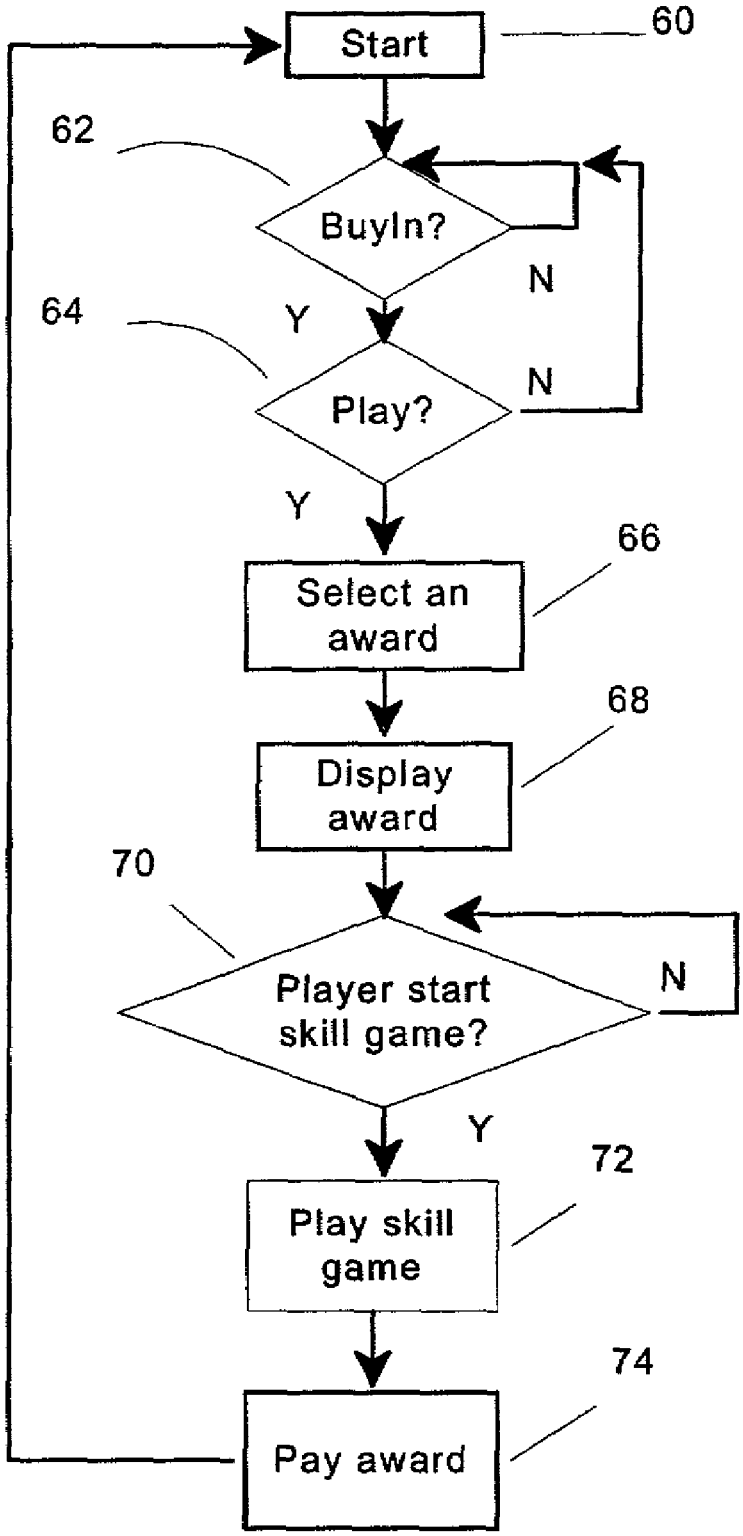
FIG. 2 is a flowchart representation of basic operation of a skill game described in the invention.

Turning now to FIG. 2, which is a flowchart representation of the aforesaid process and may be representative of a program running on a microcomputer controlling a game on gaming machine 10, program begins at 60 where initialization of said program is performed. The program proceeds to step 62 where a determination is made as to whether a game has been purchased and the amount of purchase a player desires to make, after which program proceeds to step 64 to check if a player wants to begin game play. If game play is not selected, program proceeds back to 62 to allow a player to increase the amount of buy in and also the amount of potential award. If game play is desired, program proceeds to 66 where an award is generated in accordance with a random selection procedure and said award is displayed to a player in step 68. At step 70 the program waits to start a skill game that is possible to complete with an ordinary amount of skill. The program proceeds to step 72 at which said game of skill is played by a player and any award due is paid at step 74 after which the program returns to 60 and is ready for a new game.

Figure 4:
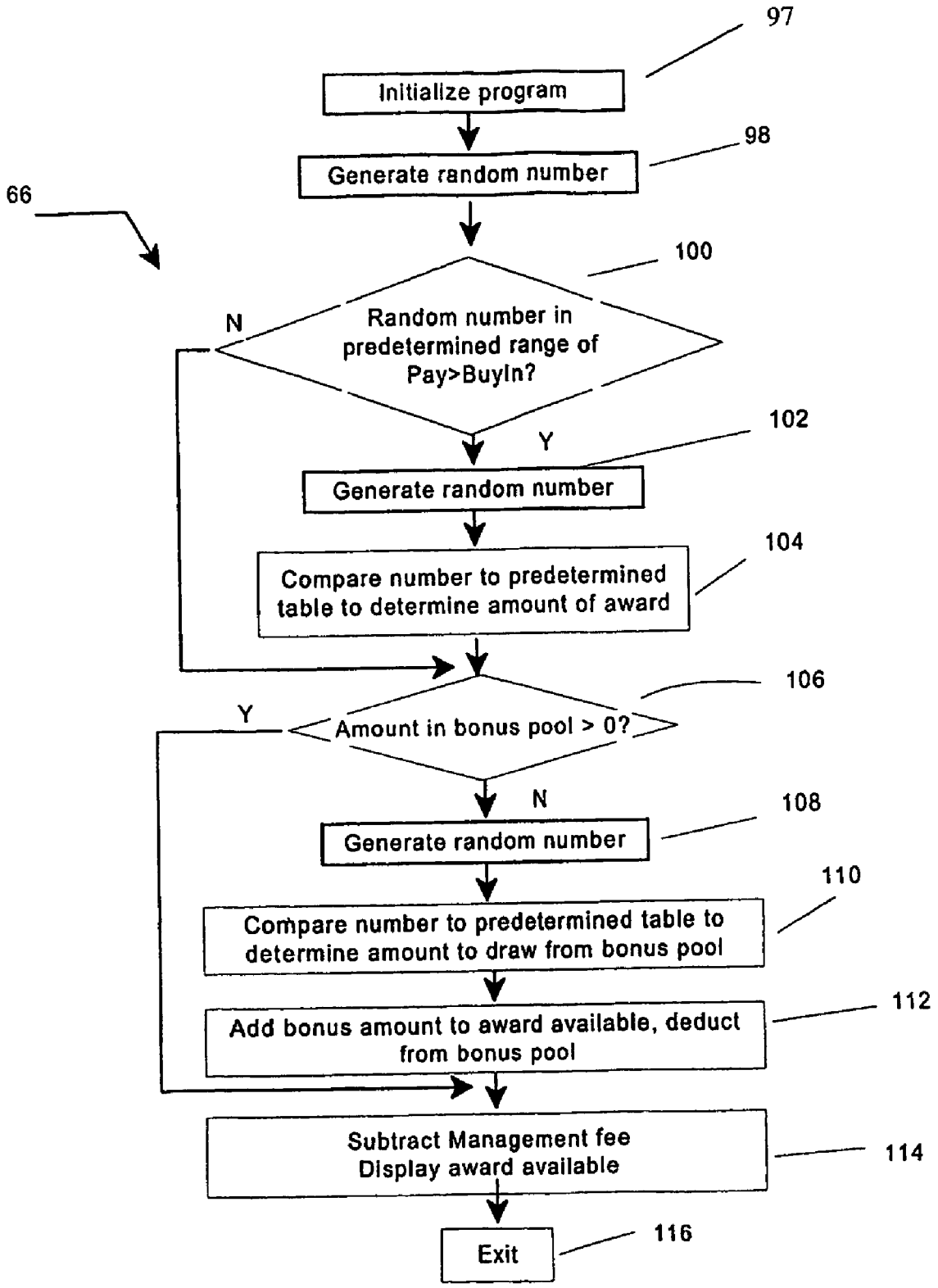
FIG. 4 is a flowchart representation of a means of selecting an award to a player according to the present invention.

Turning now to FIG. 4, which is a flowchart representation of a program running on a microcomputer for purpose of generating an award available to a player after said player has purchased a game and has signified that game play is desired. The method presented here is one of many random pay determinations that could be used. One possible alternative is presented in U.S. Pat. No. 5,380,008. Another method of generating an award to a player is as described in U.S. Pat. No. 6,053,813. Program begins at 97 where constants such as seed are recovered and said process is initialized. At step 98 a random number is generated and said random number is checked at 100 to see if it falls within a predetermined range. If the random number generated is not within bounds of said predetermined range, the process continues to step 106. If the random number generated is within bounds of the predetermined range, the process continues to 102 where a second random number is generated. Said second random number generated is compared to a predetermined table of values or ranges of values at 104 and a determination of an award is made. The process continues to 106 where a determination as to amount of available credits in a bonus pool is made. If available credit in said bonus pool is not greater than zero, the process continues to 114, if available credit in the bonus pool is greater than zero, the process continues to 108 where a random number is generated, continues to 110 where said random number generated at 108 is compared to a predetermined range of values to determine an amount to draw from the bonus pool. The amount drawn from the bonus pool is deducted from the bonus pool and the amount drawn from the bonus pool is added to the award available to a player at 112. An award, minus management fee, available for successful completion of a game of skill that is presently being played is displayed at 114. Process continues to 116 where it exits.

Figure 3:
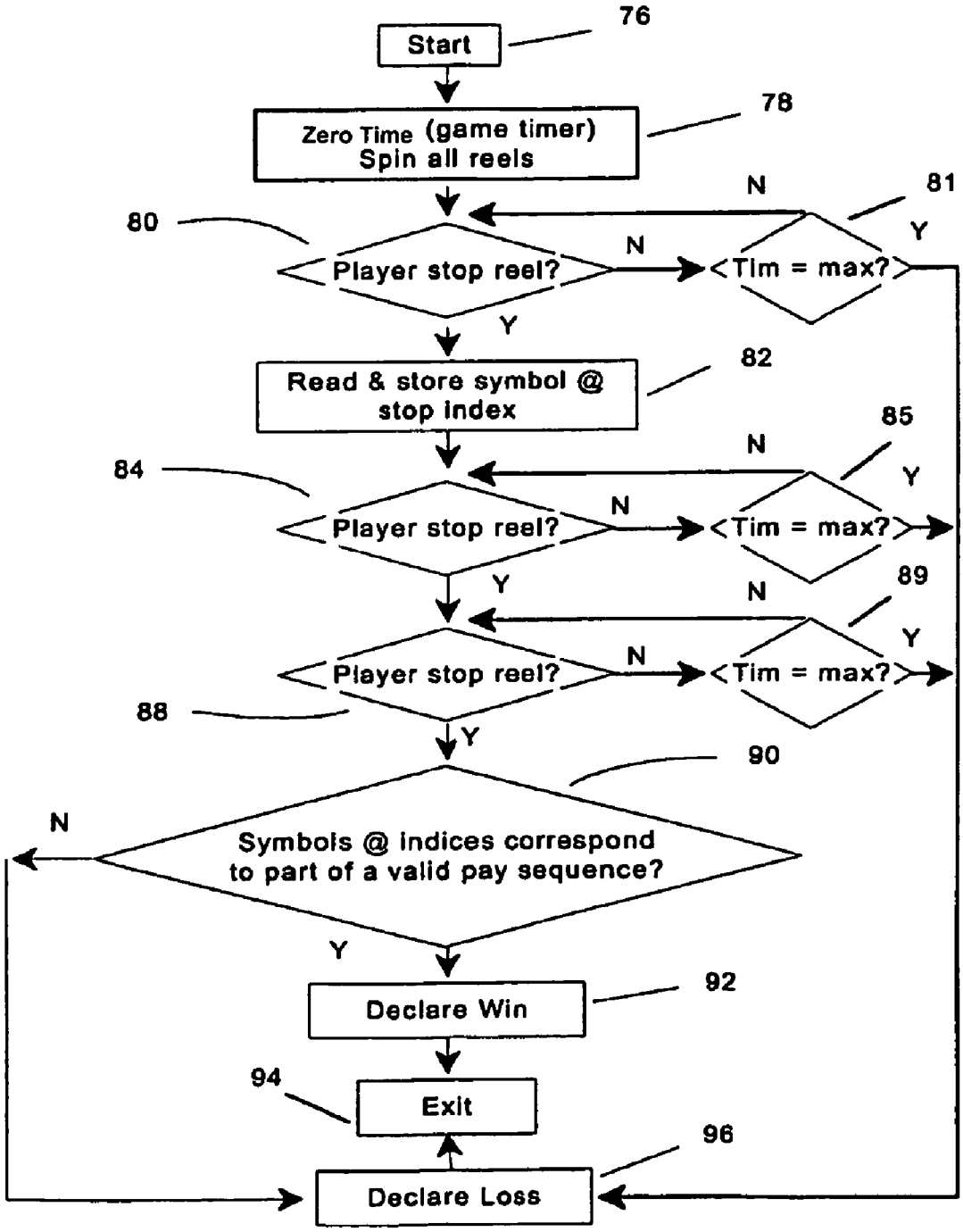
FIG. 3 is a flowchart representation of a spinning reel game operation according to the present invention.

Turning now to FIG. 3, which is a flowchart representation of a program running on a microcomputer operating gaming apparatus 10, said program may be a skill game portion of a spinning reel representation of a 3 reel slot machine on display 50. The flowchart represents skill game play and as such may be contained within block 70 of FIG. 2. Program begins at 76 and continues to 78 where physical reels or a representation thereof begin to rotate simultaneous with setting a count-up background timer cumulative count to zero. The program continues to 80 where it pauses waiting for a stop indication from a player, said stop indication may be by means of a player depressing switch 20, 22, or 24 or by other means such as pressing a representation of a switch on a touch panel covering a video monitor. Program continues to 81 to see if said background timer has accumulated time greater than maximum time allowed to complete the skill game. If the background timer's cumulative count has not exceeded maximum time allowed to complete the skill game, the program continues back to 80 to wait for the player to stop a reel. If the reel is stopped, the program continues to 82 where it reads reel position and relates said reel position to a symbol that is beneath payline 30. Said symbol directly beneath said payline is used as the basis for a payline 38 in award table 36 and all subsequent symbols for the remaining two reels must be stopped beneath the payline and be in order and of proper value as shown in 38 to allow successful completion of the skill game. Program continues to 84 where it checks to see if the player has attempted to stop one of two reels still rotating. At 85 a check is made to see if a background timer has accumulated time greater than the maximum time allowed to complete the skill game. If a predetermined time has not been exceeded, the program returns to 84 to wait for the player's reel stop command. Upon receiving a reel stop command at 84, the program proceeds to 88 to check to see if the player has attempted to stop the remaining rotating reel. At 89 a check is made to see if a background timer has accumulated time greater than the maximum time allowed to complete the skill game. If a predetermined time has not been exceeded, the program returns to 88 to wait for the player's reel stop command. Upon receiving a reel stop command at 88, the program proceeds to 90 to compare the position of each stopped reel to the award table 36. If the position of each stopped reel compares exactly to an allowed sequence as shown in award table 36, the program proceeds to 92 where successful completion of the skill game is indicated to the player and an award is credited to the player's account. The program exits game play at 94. If the position of each stopped reel does not compare to an allowed sequence as shown in 38, the program proceeds to 96 where it is indicated to the player that the skill game was not completed successfully and the entire cost of the game is deducted from the player's account at 96. The program exits game play at 94.

Figure 5:
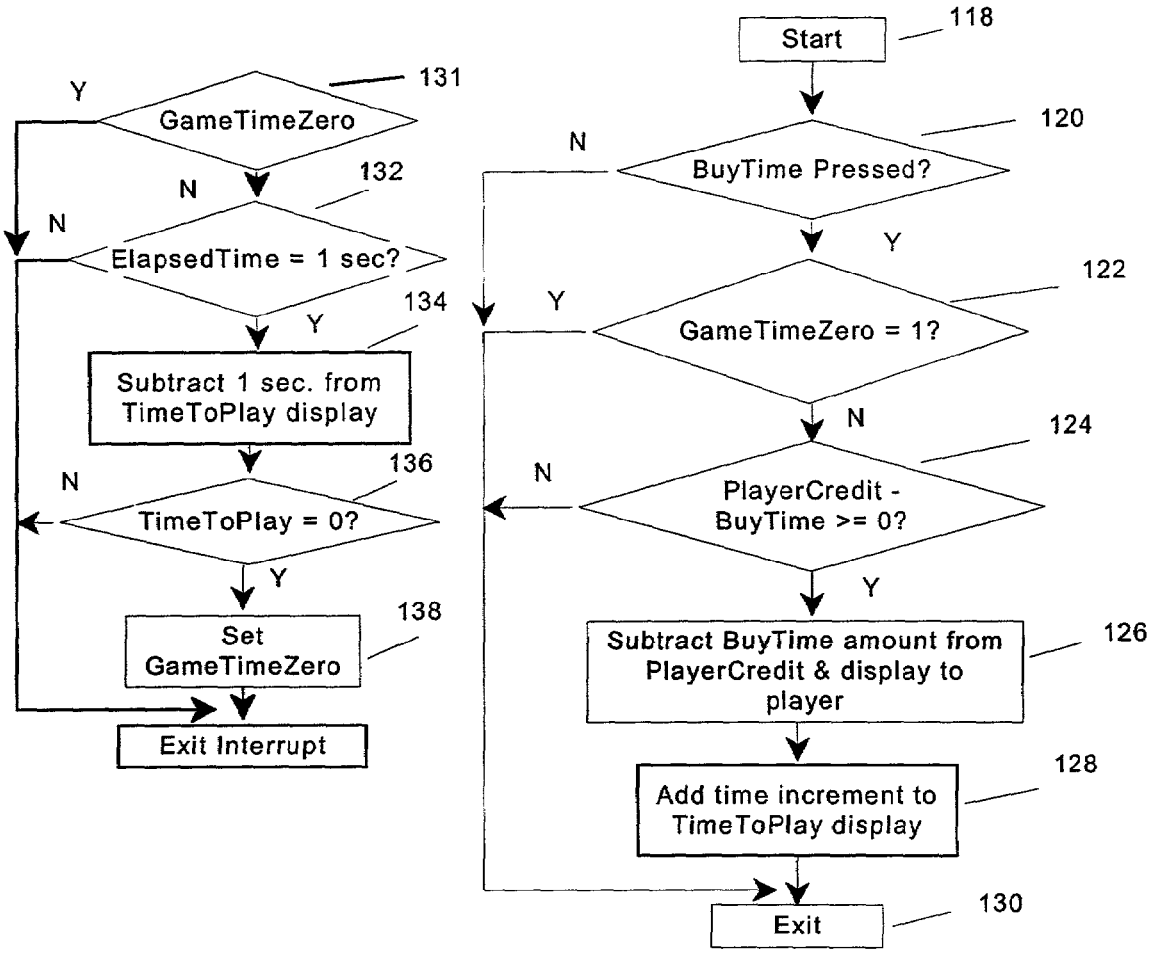
FIG. 5 is a flow chart representation of a time to play aspect according to an embodiment of the present invention.

Turning now to FIG. 5, which is a flowchart representation of method of selecting time allowed to play a game according to the present invention, the program begins at 118 where any required initialization is performed and proceeds to 120 where a check is made to determine if a player has pressed a button allowing purchase of additional time to complete a skill game. If said button has not been pressed, the program continues to 130 where it exits. If the button requesting purchase of additional time to complete said skill game has been pressed, the program continues to 122 where a determination is made as to whether a predetermined time to complete the game of skill has been exceeded and, if not, program continues to 124. If the predetermined time to complete the skill game has expired, the program proceeds to 130 where it exits. At 124 the program checks the player's account to determine that a charge for time can still be allowed and if the amount in the player's account minus charge for additional time to play the skill game is greater than or equal to zero, the program continues to 126 where a charge for additional time to play the skill game is deducted from the player's account, the program continues to 128 where the additional time to play the skill game is added an internal TimeToPlay register and is also displayed to the player; the program exits at 130. If, at 124, there are not sufficient funds in the player's account to allow him to buy extra time to play the skill game, the player is notified of such and the program continues to 130 where it exits.

Also illustrated in FIG. 5 is a flowchart representation of a background timer that typically runs under timer interrupt. Said background timer may be used for many purposes, but is illustrated here as a timer of the time allowed to play the skill game. Generally and typically timer tics are divided into small units and are accumulated in a register. At 131 a determination is made as to whether a memory flag called GameTimeZero is at a logic one or zero; if GameTimeZero is at logic one program continues to 139 where it exits the interrupt routine, it GameTimeZero is at logic zero, program continues to 132. At 132 a determination is made as to whether said register has accumulated a sufficient number of timer tics to correspond to a 1 second interval, if not, the timer exits interrupt at 139. If a 1 second interval is indicated, the program continues to 134 where a time period of 1 second is subtracted from a TimeToPlay register and displayed on a TimeToPlay display to the player. The program continues on to 136 where it compares the value in the TimeToPlay register to zero and if not zero, the program continues to 139 where it exits interrupt. If the TimeToPlay register is zero, the program continues to 138 where a register flag, GameTimeZero, indicating that game time has expired is set and the program exits interrupt at 139.

Figure 6:
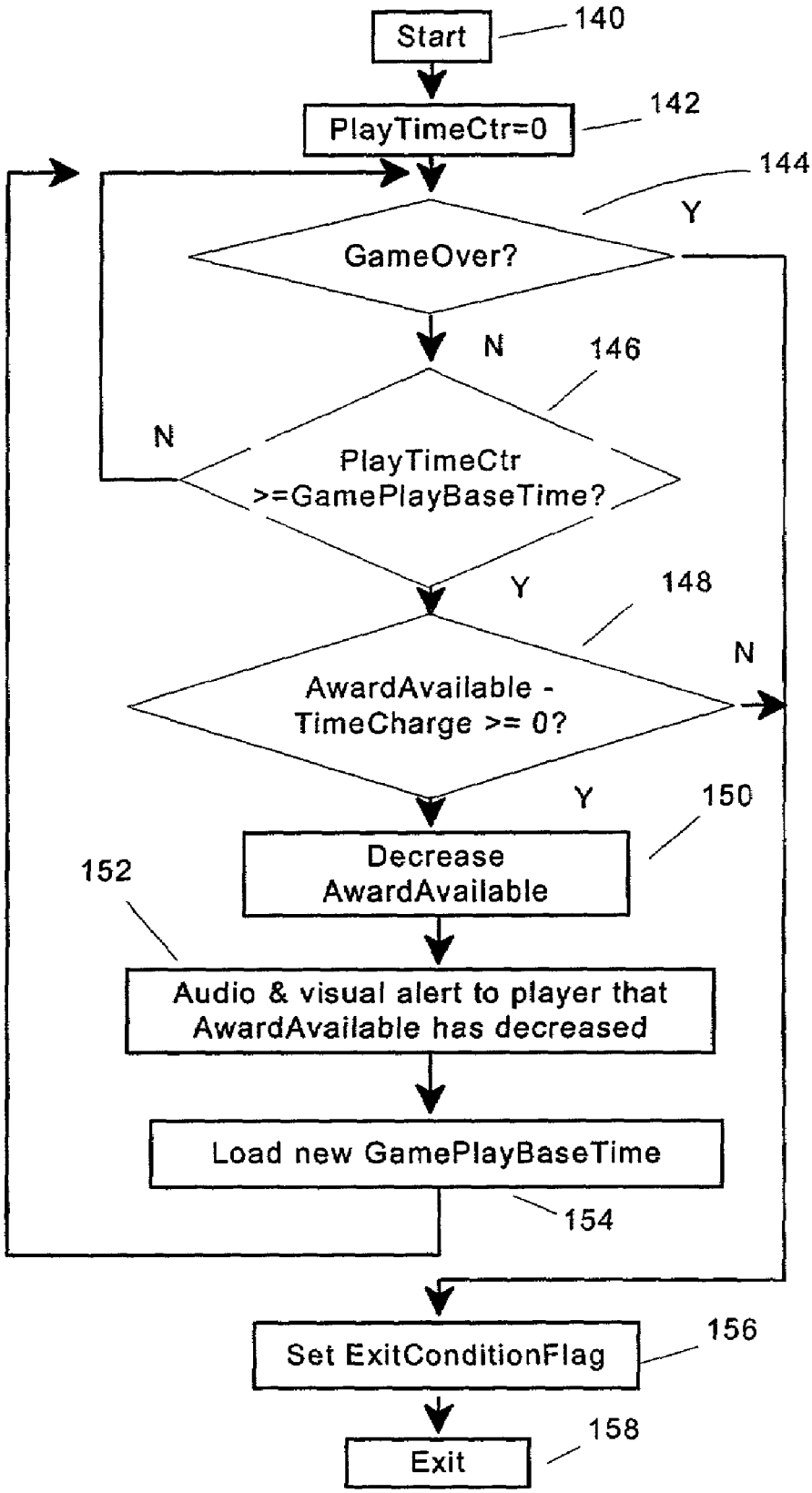
FIG. 6 is a flowchart representation showing a method of allowing a player to purchase more time to complete a game according to the present invention.

Turning now to FIG. 6, which is a flowchart representation of a program running on a microcomputer contained within game apparatus 10, said program provides for automatic deduction from an available award to a player as a predetermined time allowed for playing a game of skill is exceeded. Program begins at 140 where initialization of memory locations is performed. Said program continues to 142 where a memory location that accumulates time taken to complete a skill game is initialized to zero time. The program continues to 144 where a determination is made as to whether said game of skill has been completed by a player and if the game of skill has been completed, the program continues to 156, where a memory location is updated to reflect conditions existing at time of exit and the program continues to 158 where it exits. If, at 144, the game of skill has not been completed by a player the program continues to 146 to determine if a predetermined time to play the game of skill has been exceeded; if not, the program returns to 144. If said predetermined time to play the game of skill has been exceeded, the program continues to 148, where a determination is made as to whether the award available to the player is greater than or equal to a predetermined amount to be charged as a penalty for exceeding a predetermined time allotted to complete a game of skill; if the amount of award available minus a charge for a time increment is greater than or equal to zero, the available award to said player is decreased by a predetermined amount at 150, the program continues to 152 at which an audio and visual indication is given to the player that the award available has been decreased and the program continues to 154 where an adjusted time allowed to complete the game of skill is loaded; program then proceeds to 144. If, at 148, the award available minus a charge for a time increment is not greater than zero, the program continues on to 156 where a memory location is updated to reflect conditions existing at time of exit and the program continues to 158 where it exits.

Figure 7:
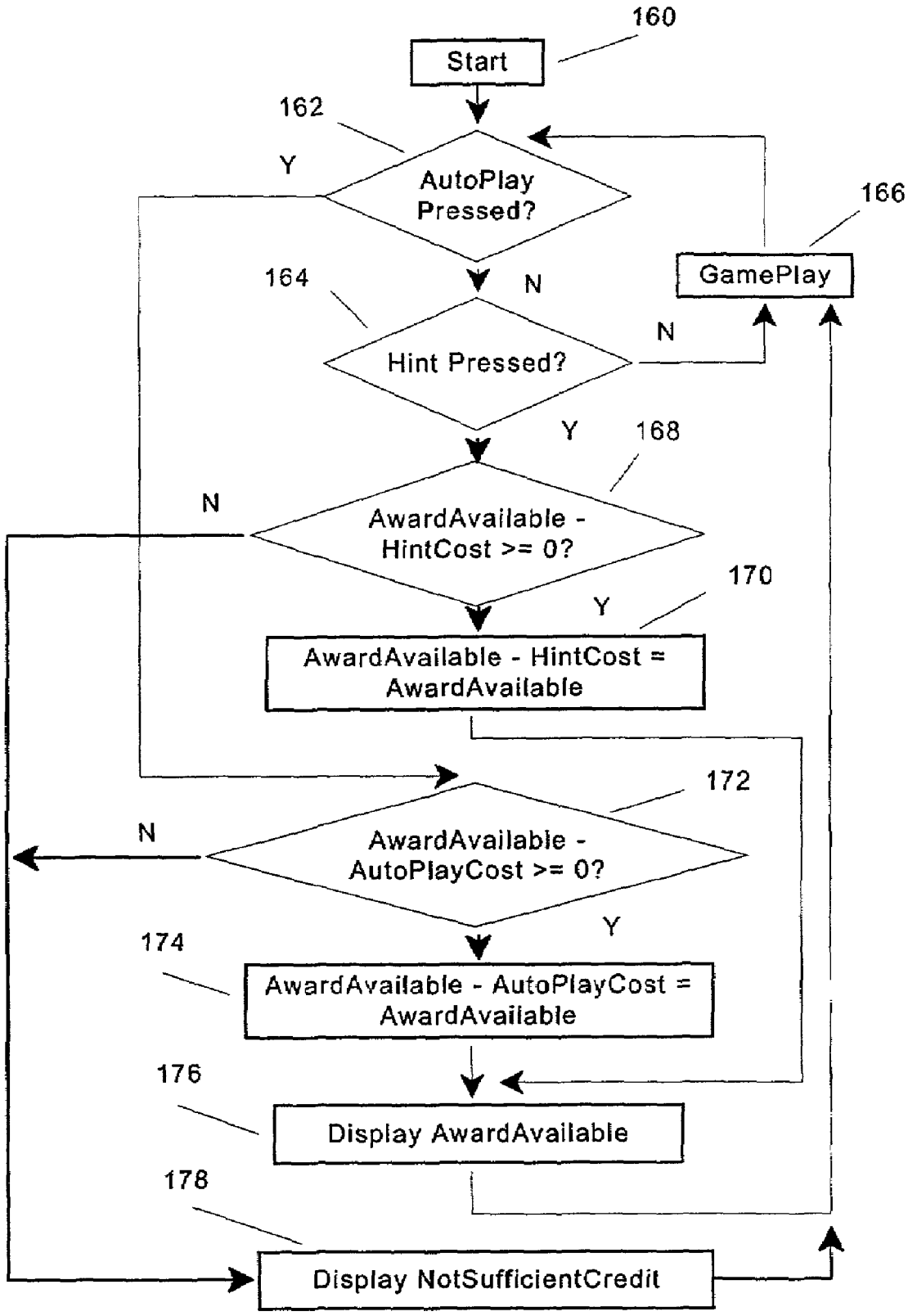
FIG. 7 is a flowchart representation of a method of allowing a player to purchase aid to successfully complete a skill game according to the present invention.

Turning now to FIG. 7, which is a flowchart representation of a program running on a microcomputer contained within game apparatus 10, said program provides for a method of allowing a player to buy advice to complete a game of skill from a program running on said microcomputer. Program begins at 160 where registers may be initialized and proceeds to 162 at which a determination is made as to whether a player has selected an auto play feature, if auto play is not selected, program proceeds to 164 to determine if game hint feature is selected and, if not, program proceeds back into a main game program at 166 from whence it proceeds to 162. If, at 162, a player selects said auto-play feature, the program proceeds to 172 where determination is made as to whether an award available to the player for successful completion of a game of skill minus an amount that will be assessed against said award for cost of auto-play is greater than or equal to zero and if not greater than or equal to zero, the program proceeds to 178 where the player is informed that sufficient credit does not exist to allow auto-play and then on to 166. If, at 172, sufficient credit exists to allow auto-play, the program proceeds to 174 where an amount assessed for auto-play is deducted from the award available, the program proceeds to 176 where the award available is displayed to the player and then to 166 to continue game play. If, at 164, the player has indicated that a hint is desired to complete the skill game, the program proceeds to 168, where determination is made as to whether an award available to the player for successful completion of a game of skill minus an amount that will be assessed against said award for cost of a hint is greater than or equal to zero and if not greater than or equal to zero, the program proceeds to 178; if aforesaid inequality results in a solution greater than or equal to zero, the program continues to 170 where an amount assessed for a hint is deducted from the award available, the program proceeds to 176 where the award available is displayed to the player and then to 166 to continue game play. Auto-play allows a program running on a microcomputer controlling the game to make a single selection that will result in the best solution for the point in the game cycle at which auto-play is applied; hint allows the player to make a decision or to give the player an advantage to complete the game at a point in the game cycle at which hint is applied.

Figure 9:
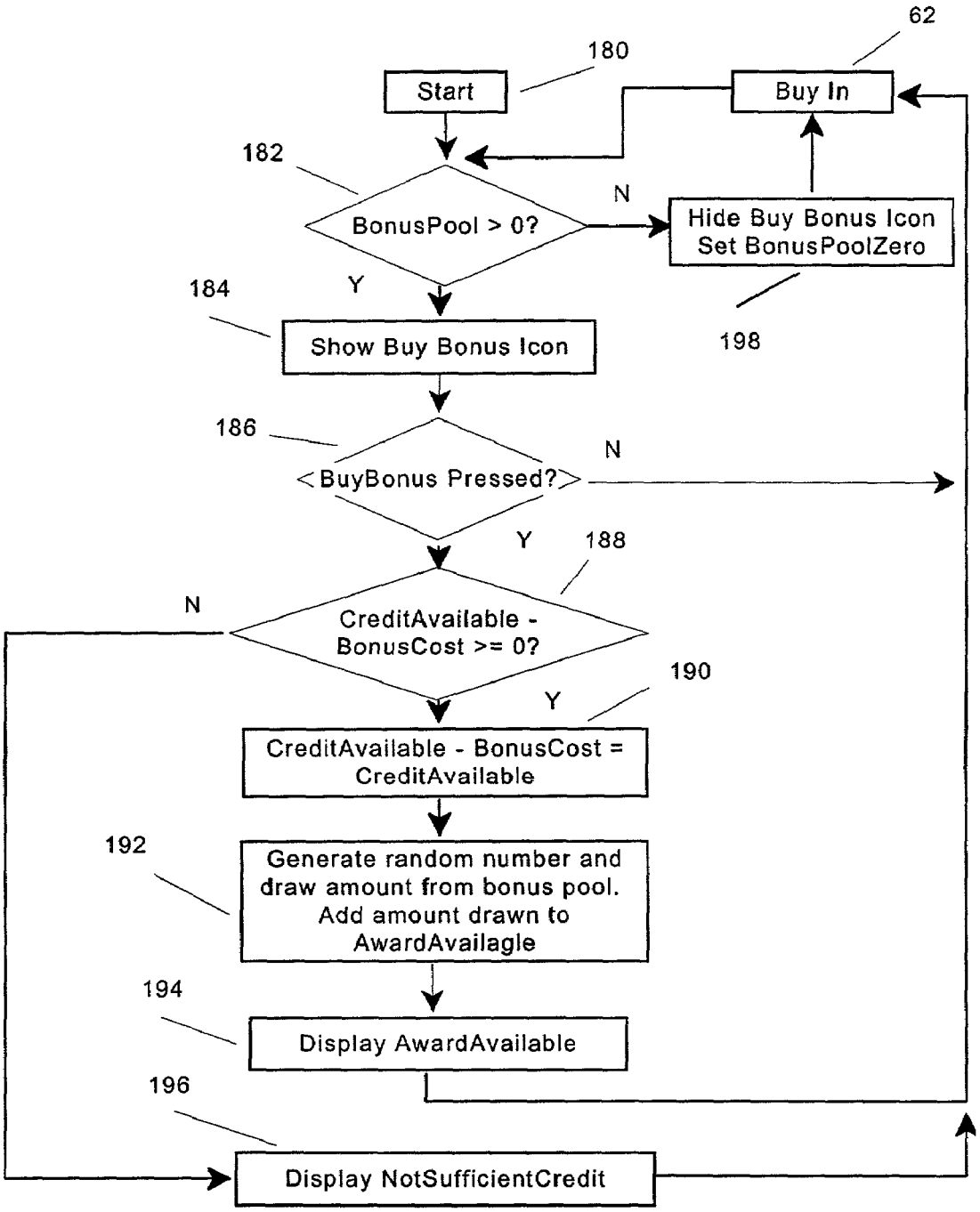
FIG. 9 is a flowchart representation of a program running on a microcomputer that allows a player to manually buy into a bonus pool.

Turning now to FIG. 9, which is a flowchart representation of a program that may be running on a microcomputer to provide for a player-elected buy-in to an award from a bonus pool, said program begins at 180 where initialization may be performed. The program continues to 182 where a determination that an amount in said bonus pool is greater than zero and if greater than zero, proceeds to 184 where an icon beneath a touch screen is shown to the player to allow purchase of a portion of the bonus pool; if a decision is made by the player to purchase a randomly selected portion of the bonus pool at 186, the program continues to 188 where a determination is made as to whether the player has sufficient credit to afford a cost of purchasing a portion of the bonus pool. If the player's credit is not sufficient, the program continues to 196 where the player is informed that sufficient credit does not exist and then to 62, where buy-in decisions are performed. If, at 188, the player has sufficient credit to purchase a portion of the bonus pool the program continues to 190 where the cost of purchasing a portion of the bonus pool is deducted from the player credit available and then on to 192 where a random number is generated to determine a portion of the bonus pool to allot to the player during the present game and the amount of said portion of the bonus pool is added to the award available to the player for completion of the skill game. The portion of the bonus pool that is determined for the player at 192 will always be greater than zero, this is important as the buy-in to the bonus pool is then a transaction rather than a chance. Program continues to 194 where the award available to the player is displayed to him on 35; program continues to 62. At 182, if the bonus pool is not greater than zero, the program continues to 198, where the bonus icon is hidden from the player and a computer memory flag called BonusPoolZero is set to signal to the main program that offering of bonus pool buy-in by a player should not be allowed; program continues to 62. If, at 186, the player elects not to purchase a portion of the bonus pool the program continues to 62.

In a preferred embodiment, gaming apparatus 10 may comprise any well-known electronic gaming apparatus controlled by a microcomputer or microcontroller. A method of choosing a random game outcome as taught in U.S. Pat. No. 5,380,008 may be employed here. Another method of choosing a random game outcome is as described in U.S. Pat. No. 6,053,813. For purposes of simplicity in illustration, assume the following: skill game is a three-reel multiplier type game, 50% management fee is deducted from each coin played. Calculations are for a single coin played, but since said game is a multiplier said calculations will apply to multiple coin plays and awards. The following demonstrates that a skill game requiring an average level of human dexterity and skill to complete incorporating the principles of the current invention can return a profit to an operator of a game.

| | | |
|---|---|---|
| Payline 1 | Pay 2 | Hit Frequency = 0.1500 |
| Payline 2 | Pay 5 | Hit Frequency = 0.0300 |
| Payline 3 | Pay 10 | Hit Frequency = 0.0100 |
| Payline 4 | Pay 20 | Hit Frequency = 0.0010 |
| Payline 5 | Pay 50 | Hit Frequency = 0.0004 |

Summation of Hit Frequency=0.1940 and 1-(Hit Frequency) =0.80860

The above predicts that about 1 game out of every 5 games played will result in a payline award to a player; to collect said payline award, said player must successfully complete a game of skill. A 50% management fee implies that for a single coin played that 50% of said coin played would be credited to an operator of a game. If a player plays 1 coin and is to be paid two coins, actual payback to said player is 2 coins−(1 coin)(0.50)=1.50 coins. Also, if a player draws the equivalent of a losing game on a conventional slot machine for which he would generally be paid nothing, said player would be paid 1 coin−(1 coin)(0.50)=0.50 coins upon successful completion of a game of skill. If the player does not successfully complete said game of skill, then no award is returned and credited to the player's account.

Payline 1

P.C.=(Payline Hit Frequency)(Number of Coins Paid−Management Fee)/(Number of Coins Played)

$$PC1=(0.150)(2-0.5)=0.22500$$

Payline 2

$$PC2=(0.030)(5-0.5)=0.13500$$

Payline 3

$$PC3=(0.01)(10-0.5)=0.09500$$

Payline 4

$$PC4=(0.001)(20-0.5)=0.01950$$

Payline 5

$$PC5=(0.0004)(50-0.5)=0.01980$$

Total P.C.=0.49430. To account for the games that do not have a payline pay, calculate (1−Total Hit Frequency)(Number of Coins Paid−Management Fee)=(0.80860)(1−0.5) =0.4043. Total return to a player with this game is 0.49430+0.4043=0.89860, which indicates that approximately 89.86% of the coins played will be returned to players over a large number of plays. If it is assumed that an operator of a game desires a 95% return to players, which is a generally acceptable value, then 95% −89.86% =5.14% is available to be placed into a bonus pool. Additionally, any skill games not completed successfully by players will contribute to the amount retained and any total return to players less than a predetermined value may be placed into a bonus pool to be employed to enhance awards.

If P.C. is less than a predetermined amount, it may be distributed to players by numerous means. A random means of accomplishing distribution of excess machine hold that employs a method as described in U.S. Pat. No. 6,053,813 for a game is as follows:

Assume the same random number generation and filter constants as described in aforesaid patent, the digital filter has a passband of 1 through 9; the range of random numbers generated is 1 through 37, the sequential count of random numbers that must pass through the filter passband in a sequence to obtain an award from the bonus pool is indicated below. The count of random numbers generated and presented to the filter input for each game will be 6.

| Sequential Count of numbers within passband | Percent of Bonus Pool (Bonus) |
|---|---|
| 0 | 0% |
| 1 | 8% |
| 2 | 10% |
| 3 | 12% |
| 4 | 15% |
| 5 | 20% |
| 6 | 35% |

A set of random numbers is generated after possible award amount for a game is calculated. Depending upon the sequential count of numbers within the filter passband as given above, a percentage of the bonus pool is allocated and summed with said possible award amount previously calculated. Process is:

1) Calculate an award amount for present game.
2) Generate a second set of random numbers and calculate a percentage of the bonus pool to be allocated to game. This is labeled "Bonus".
3) Multiply decimal equivalent of Bonus by bonus pool amount to obtain an integer value. This is the Bonus Adder.
4) Subtract Bonus Adder from bonus pool amount and store value obtained in the bonus pool.
5) Sum Bonus Adder with possible award amount calculated and display amount that can be won to player.
6) Begin skill game.

As an example, assume that the bonus pool value=100, possible award amount=2, and 3 random numbers generated are sequentially within the filter passband for bonus calculation. The calculation is (100)(0.12)=12=Bonus Adder. The new bonus pool value=100−12 =88. Player is shown that he can win (possible award amount)+Bonus Adder=2 +12=14 coins. If a bonus pool buy-in decision is offered to a player, the minimum portion of the bonus pool that will be randomly selected will always be greater than zero.

In another preferred embodiment, which may be a video skill game presentation that employs a touch screen for player input and which appears to a player as a video representation of a traditional spinning reel slot machine, there exist a plurality of paylines 38 comprising a paytable 36 and which may have values as predetermined by desired hit frequency and payback percentage to players (P.C.), but which are shown for purposes of illustration as follows:

| Payline # | Symbols on payline to win | Pay (coins or credits) |
|---|---|---|
| 1 | Any CH | 2 |
| 2 | Any two CH | 5 |
| 3 | Any 3 Bars | 5 |
| 4 | Bar Bar Bar | 10 |
| 5 | CH CH CH | 20 |
| 6 | 5Bar 5Bar 5Bar | 50 |
| 7 | SP SP SP | >50 |

The word CH is an abbreviation for cherry and the word SP is an abbreviation for special symbol, which may be a custom logo, or any other symbol that is different from symbols referenced in the paytable above. Game presentation to a player is similar to FIG. 1. Initially all paylines in 36 are hidden from a player and an attraction message may be shown explaining how to play the skill game. Said player inserts currency at 25 and, after currency has been authenticated, credits corresponding to said currency inserted are displayed at 21 and may be used by the player to buy a skill game by means of pressing a buy-in button or icon 26. When 26 is pressed, a microcomputer controlling 10, performs a calculation that may be as in flowchart in FIG. 4 to determine an award available to the player which may be paid upon the player successfully completing a skill game. Upon determining said award available, paylines in the paytable shown above that are less than or equal to the award available are displayed to the player. Reels 40, 42, 44 appear to rotate and the player must stop them by means of buttons or icons 20, 22, 24 in accordance with a sequence shown in a payline number, within a predetermined time shown on 33 and, with symbols shown in a selected payline number chosen by the player, directly beneath payline 30 in order to claim an award displayed at said payline selected by the player. Additionally, the first symbol that is stopped beneath the payline by the player will determine the payline with which the remaining symbols must correspond in order to win the award indicated by said payline. As an example, after player buy-in and prior to start of the skill game, a random number generated at 102 and compared to a predetermined table in computer memory at 104 indicates that an award available to a player should be 5 coins. A display of paylines on paytable 36 will be:

| Payline # | Symbols on payline to win | Pay (coins or credits) |
|---|---|---|
| 1 | Any CH | 2 |
| 2 | Any two CH | 5 |
| 3 | Any 3 Bars | 5 |

Reels 40, 42, 44 appear to spin and the player must stop them with symbols beneath payline 30 within time allotted as displayed upon 33 in order to win the award available as indicated by the payline. If, in a first case, if the player stops a reel with a cherry (CH) icon beneath payline 30, he can win at least 2 coins minus management fee; if a subsequent reel is stopped with a cherry icon beneath 30, then the player can win 5 coins minus management fee. If the player stops one reel with a bar or 5Bar beneath 30, he may proceed to stop the remainder of the reels with a bar or 5Bar beneath 30 and he will win 5 coins or credits minus management fee as stated on payline 3. If the player stops a reel with a bar or 5Bar beneath 30 and then stops a reel with a symbol other than a 5Bar or bar beneath 30 and then stops the remaining reel with a cherry (CH) beneath 30, he will win 2 coins or credits minus management fee; if the remaining reel is stopped with any symbol other than a bar, 5Bar or cherry beneath 30 and the second reel stopped is not stopped with a bar or 5Bar or cherry beneath 30, the player has zero added to his credit account.

If the amount of the award available to the player is determined to be the buy-in amount minus management fee, a single payline as shown below may be shown:

| Payline # | Symbols on payline to win | Pay (coins or credits) |
|---|---|---|
| 1 | Any CH | 1 |

The player must still complete the skill game successfully in order to be paid the buy-in amount minus management fee. If the skill game is not completed successfully no award of any amount is returned to the player. Total number of different symbols or icons upon reels may be four as may be seen from the paytable. In a version of the preferred embodiment all reels may present an identical presentation and that may be aforesaid four symbols alternating, separated by a blank space and repeated twice. A reel would then appear as CH, Blank, Bar, Blank, 5Bar, Blank, SP, Blank, CH, Blank, Bar, Blank, 5Bar, Blank, SP, Blank. It is not required that different numbers of symbols be included upon each reel in order to weight game outcome, though different combinations of symbols included upon each reel may affect return of awards to players and must be included in game hold calculations.

In another example of aforesaid game, after player buy-in and prior to start of the skill game, a random number generated at 102 and compared to a predetermined table in computer memory at 104 indicates that an award available to a player should be 5 coins. Additionally let a bonus amount of 20 credits be drawn from the bonus pool at 110 and this amount is added to the 5 credits determined to be the previous award available. Total amount of credits that may be won by the player is 25 as calculated at 112 and is shown to the player by showing a paytable composed of paylines as follows:

| Payline # | Symbols on payline to win | Pay (coins or credits) |
|---|---|---|
| 1 | Any CH | 2 |
| 2 | Any two CH | 5 |
| 3 | Any 3 Bars | 5 |
| 4 | Bar Bar Bar | 10 |
| 5 | CH CH CH | 25 |

In order to win the maximum award the player must stop all three reels with a cherry directly beneath payline 30. If the player stops the first reel with any symbol but a cherry beneath payline 30, the maximum amount of credits he can win upon successful completion of the skill game is 10 (Bar Bar Bar). The features of buy time and auto-play may still be made available to the player in this preferred embodiment. Hand-eye coordination and reaction time are the elements of skill tested in the aforesaid game.

A second method of distributing excess winnings of a skill game apparatus, if the playback percentage to players (P.C.) is less than a predetermined amount, may be by means of stopping several reels of a reel type game at winning symbols and leaving a single reel to be stopped at a winning symbol by a player. Said method has an effect of mailing a skill game very simple to complete and is in accordance with a second method of bonus distribution to a player previously described.

Figure 8:
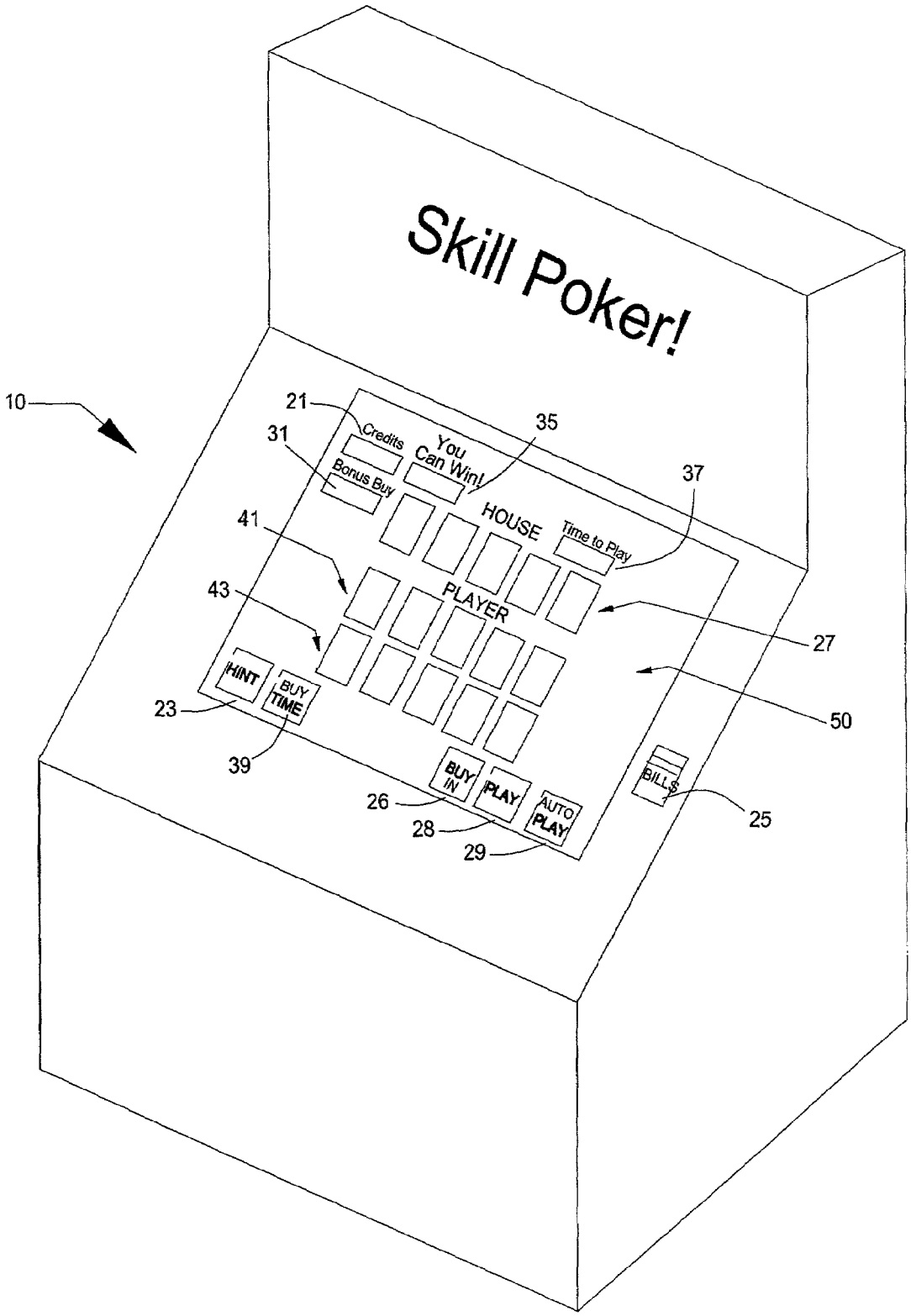
FIG. 8 is a perspective view of another skill game apparatus described in a preferred embodiment.

In yet another preferred embodiment, which may be a video skill game presentation that employs a touch screen for player input, it is assumed that there exist a plurality of tables of predetermined winning playing card hands in computer memory from which to choose. Said video skill game if played upon a game apparatus 10 in FIG. 8 controlled by a microcomputer. In the preferred embodiment a hand consists of 5 cards and the skill game is conducted in accordance with rules associated with a poker game. Only a card suit and spots are shown on cards employed in the game and no number indicating card value is shown; only spots and faces are shown. The skill game has an arbitrary 15-second timer in which it must be completed or player loses the game, said 15-second timer may be adjusted by an operator of the game apparatus and a player is shown remaining time to complete the skill game on display 37. A player purchases credits to play a game on 10 by inserting currency into acceptor 25 and amount of credits available to play games is displayed to said player on credit display 21, display to the player 50, is preferably a video display overlaid by a transparent touch screen which may be manufactured by MicroTouch. Said touch screen allows buttons and icons to act as buttons to be shown beneath the touch screen and touching an icon may effect a switch closure. Consequently icons may be placed at various positions on the video display and have switches associated with said icons in a manner that is very simple to understand. Play of the skill game is in accordance with the flowchart shown in FIG. 2. The player decides to play the skill game and purchases a game by pressing icon 26, credits are deducted from the player's credits and credits remaining to the player are shown on 21. When the player indicates that he desires to play the game of skill, which he may do by pressing 28, game play begins as indicated in 64. An award that may be won by successful completion of the game of skill is displayed to the player at 35; said award is determined randomly by a program running on a microcomputer controlling game apparatus 10 and may be in accordance with a flowchart shown in FIG. 4. The award available to the player will be won by him at successful completion of the skill game. Additionally, a management fee is subtracted from each coin the player submits to purchase a skill game; multiple purchases of the same game may be made with a corresponding increase in the award available to be won upon successful completion of the skill game. The skill game preferably proceeds as follows:

1) Generate a random number and employ said random number to choose a particular table of winning hands from said plurality of winning hands in computer memory. Generate a second random number and pick a particular winning hand based upon said second random number generated. Said particular winning hand is the house hand and is shown face-down (card backs up) 27.
2) Randomly choose 5 cards by generating random numbers and choosing card values that have been predetermined to be associated with said cards. Said 5 cards selected comprise one part of the player's hand and are not yet shown.
3) A program running on the microcomputer controlling the game chooses a second hand of 5 cards for the player that is guaranteed to beat the house hand. The program running on the microcomputer then makes five pairs by drawing a card from each individual player hand drawn in step 2 and step 3. Shuffle each pair and present them to the player as in FIG. 8, at 41 and 43. All cards are still face-down.
4) Presentation will now be:

| | | | | | |
|---|---|---|---|---|---|
| H1 | H2 | H3 | H4 | H5 | House Hand |
| P1U | P2U | P3U | P4U | P5U | Player Upper Hand |
| P1L | P2L | P3L | P4L | P5L | Player Lower Hand |

5) The house hand 27 is turned face-up for view by the player for a predetermined time period that may be adjusted by the operator of the game apparatus, 1.5 seconds is default predetermined time period and then the house hand is turned face-down to prevent the player from further visual reference to card values in the house hand.
6) P1U and P1L are turned face up for view by the player. The player chooses P1U or P1L to keep. The card the player does not keep is removed from view and the remaining card, P1, is turned face-down again.
7) Continue as in step 6 for remainder of the player's 4 card pairs. The cards remaining after said selection process are the player's hand. Presentation will now be:

| | | | | | |
|---|---|---|---|---|---|
| H1 | H2 | H3 | H4 | H5 | House Hand |
| P1 | P2 | P3 | P4 | P5 | Player Hand |

8) The player's hand and the house hand are turned face up to show the player the winning hand; said winning hand is determined by rules common to a poker game. The microcomputer can determine if the winning hand is the player's hand or the house hand; if the player's hand is the winning hand, then the player has completed the game of skill successfully and the award available at 35 is credited to the credit account and shown to the player at 21. Memory and pattern recognition is the element of skill tested in the aforesaid game.

9) At steps 6 and 7 above, the player may require some help to complete the skill game. He can purchase help to complete the game by pressing auto-play button 29 or hint button 23. Pressing the auto-play button will result in the microcomputer selecting the best selection from a pair of cards for which a selection must still be made by the player. Each press of the auto-play button will result in said process repeating for a pair of cards; there is a cost to the player associated with auto-play. Pressing the hint button may result in the house hand being turned face-up for view for a predetermined time period after which it is turned face down, may display both cards in a pair from which one card is remaining to chosen or both. The hint process has a cost associated to the player. A flowchart for the auto-play and hint processes is shown in FIG. 7. Additionally, if the player desires to purchase more time to complete the skill game he may purchase an increment of time by pressing 39. A predetermined time increment is added to 154 and a new time to complete the skill game is shown on display 37. Because there is a cost to the player to gain extra time to complete the skill game, there may be a deduction from the award available for the current game, or the player credits available or both. Updated values are shown to the player on 21 and 35. A feature of the skill game just described may be to automatically adjust every random award generated from the bonus pool of excess machine hold funds or a choice may appear to allow the player to choose to have the game draw a bonus award at the time the player chooses to buy-in to play a game. A flowchart representation of a program running on a microcomputer to allow a player award to participate in a bonus pool is shown in FIG. 9.

A second method of distributing excess winnings of a skill game apparatus utilizing the card game previously described, if P.C. is less than a predetermined amount, may be by means of randomly showing elements of the house hand or by showing the house hand for a long time period. Said actions have an effect of making a skill game very simple to complete and is in accordance with a second method of bonus distribution to a player previously described.

It should be noted that the preceding discussion discloses a method of implementing a game of skill upon any computer controlled gaming apparatus and may be adapted to devices including display types and actuation devices different than those described herein. A person skilled in the art will see many other games and implementations that employ the methods disclosed herein. For example, the skill game may actually be a table game or variation thereof, such as, for example, blackjack, craps, poker, etc. Additionally, the award may comprise, for example, merchandise, gift certificates, complimentary meals, complimentary lodging, etc. It will be understood that this disclosure comprises a novel method of implementing a game of skill. Those having skill in the art to which the present invention pertains will now, as a result of the applicant's teaching herein, perceive various modifications and additions which may be made to the invention. Accordingly, all such modifications and additions are deemed to be within the scope of the invention.

What is claimed is:

1. A method of playing a skill game by at least one player, the method comprising:

paying, by the player, a buy-in fee;

selecting an award;

playing the skill game; and providing the award to a player if the player successfully completes the skill game;

wherein the award periodically reduces as the player plays the skill game.

2. A method in accordance with claim 1 wherein the award is randomly selected.

3. A method in accordance with claim 1 wherein the award is selected from a predetermined table of awards.

4. A method in accordance with claim 1 wherein the award is an amount of cash.

5. A method in accordance with claim 4 wherein the award is selected from a predetermined table of award amounts.

6. A method in accordance with claim 1 wherein the award is a prize.

7. A method in accordance with claim 6 wherein the prize is at least one of a group comprising a gift certificate, meal voucher, and hotel voucher.

8. A method in accordance with claim 1 wherein the skill game is played on a gaming machine.

9. A method in accordance with claim 8 wherein the gaming machine includes an auto-play feature that may be purchased by the player to help the player complete a portion of the skill game.

10. A method in accordance with claim 1 wherein the skill game is a table game.

11. A method in accordance with claim 1 wherein the skill game is a poker-style game.

12. A method in accordance with claim 1 wherein the player may purchase a hint to help complete the skill game.

13. A method of playing a skill game by at least one player, the method comprising:

paying, by the player, a buy-in fee;

selecting an award;

playing the skill game;

providing the award to a player if the player successfully completes the skill game; and providing an award adjustment pool, randomly generating an award adjustment, comparing the award adjustment to the award adjustment pool, adding the award adjustment to the award if the award adjustment is less than or equal to the award adjustment pool, and subtracting the award adjustment from the award adjustment pool if the award adjustment is less than or equal to the award adjustment pool.

14. A method in accordance with claim 13 wherein the award periodically reduces as the player plays the skill game.

15. A method in accordance with claim 13 wherein the award is an amount of cash.

16. A method in accordance with claim 15 wherein the award periodically reduces as the player plays the skill game.

17. A method of playing a skill game by at least one player, the method comprising:

paying, by the player, a buy-in fee;

selecting an award;

playing the skill game;

providing the award to a player if the player successfully completes the skill game; and determining an amount of awards provided to players over a period of time, determining if the amount of awards provided to players over a period of time is less than a predetermined amount, and if the amount of awards provided to players over the period of time is less than the predetermined amount, then reducing skill requirements for successfully completing the skill game.

18. A system for playing a skill game by at least one player, the system comprising:

at least one gaming machine configured for playing the skill game; and a control system that generates an award and provides the award to the at least one player upon successful completion of the skill game.

19. A system in accordance with claim 18 wherein the control system periodically reduces the award as the player plays the skill game.

20. A system in accordance with claim 18 wherein the award is an amount of cash.

21. A system in accordance with claim 20 wherein the control system periodically reduces the award as the player plays the skill game.

22. A system in accordance with claim 18 comprising multiple gaming machines.

23. A system in accordance with claim 18 wherein the control system maintains an award adjustment pool, randomly generates an award adjustment, compares the award adjustment to the award adjustment pool, adds the award adjustment to the award if the award adjustment is less than or equal to the award adjustment pool, and subtracts the award adjustment from the award adjustment pool if the award adjustment is less than or equal to the award adjustment pool.

24. A system in accordance with claim 23 wherein the control system periodically reduces the award as the player plays the skill game.

25. A system in accordance with claim 23 wherein the award is an amount of cash.

26. A system in accordance with claim 25 wherein the control system periodically reduces the award as the player plays the skill game.

27. A system in accordance with claim 23 comprising multiple gaming machines.

28. A system in accordance with claim 18 wherein the player may purchase a hint to help complete the skill game.

29. A system in accordance with claim 18 wherein the at least one gaming machine includes an auto-play feature that may be purchased by the player to help the player complete a portion of the skill game.

30. A system in accordance with claim 18 wherein the control system determines an amount of awards provided to players over a period of time, determines if the amount of awards provided to players over a period of time is less than a predetermined amount, and if the amount of awards provided to players over a period of time is less than the predetermined amount, then reduces skill requirements for successfully completing the skill game.

31. A system in accordance with claim 18, wherein the gaming machine is configured to allow the player a predetermined amount time to complete the skill game.

32. A gaming machine for playing a skill game by at least one player, the gaming machine comprising a control system that generates an award and provides the award to the at least one player upon successful completion of the skill game.

33. A gaming machine in accordance with claim 32 wherein the control system periodically reduces the award as the player plays the skill game.

34. A gaming machine in accordance with claim 32 wherein the award is an amount of cash.

35. A gaming machine in accordance with claim 34 wherein the control system periodically reduces the award as the player plays the skill game.

36. A gaming machine in accordance with claim 35 wherein the player may purchase a hint to help complete the skill game.

37. A gaming machine in accordance with claim 34 wherein the control system maintains an award adjustment pool, randomly generates an award adjustment, compares the award adjustment to the award adjustment pool, adds the award adjustment to the award if the award adjustment is less than or equal to the award adjustment pool, and subtracts the award adjustment from the award adjustment pool if the award adjustment is less than or equal to the award adjustment pool.

38. A gaming machine in accordance with claim 37 wherein the control system periodically reduces the award as the player plays the skill game.

39. A gaming machine in accordance with claim 37 wherein the award is an amount of cash.

40. A gaming machine in accordance with claim 39 wherein the control system periodically reduces the award as the player plays the skill game.

41. A gaming machine in accordance with claim 32 wherein the gaming machine includes an auto-play feature that may be purchased by the player to help the player complete a portion of the skill game.

42. A gaming machine in accordance with claim 32 wherein the control system determines an amount of awards provided to players over a period of time, determines if the amount of awards provided to players over a period of time is less than a predetermined amount, and if the amount of awards provided to players over a period of time is less than the predetermined amount, then reduces skill requirements for successfully completing the skill game.

43. A gaming machine in accordance with claim 32 wherein the gaming machine further comprises a communication conduit that is in communication with a network that comprises a control system, wherein the network control system works with the gaming machine control system.

44. A gaming method, comprising the steps of:

accepting a player buy-in;

randomly assigning an award for successful completion of a skill game;

playing the skill game; and awarding the award if the skill game is successfully competed;

wherein the award is assigned after acceptance of the player buy-in.

45. The gaming method according to claim 44, wherein a level of skill required to successfully complete the skill game is such that an ordinary person playing the skill game will successfully complete the skill game.

46. The gaming method according to claim 44, wherein a level of skill required to successfully complete the skill game is reduced if an amount paid out to players is less than a predetermined amount.

47. The gaming method according to claim 44, wherein the skill game comprises a game having aspects of luck in addition to skill.

48. The gaming method according to claim 44, wherein the skill game comprises poker.

49. The gaming method according to claim 44, further comprising the step of deducting a management fee from the award.

50. The gaming method according to claim 44, further comprising the step of offering a buy-in to a bonus pool.

51. The method according to claim 50, wherein the buy-in comprises a randomly determined portion of the bonus pool.

52. The method according to claim 44, further comprising the step of displaying an offer to buy-in to a bonus pool if the bonus pool is greater than a predetermined threshold; and removing the offer to buy-in if the bonus pool is not greater than the predetermined amount.

53. The gaming method according to claim 44, wherein the award is randomly assigned after accepting the wager and prior to playing the skill game.

54. The gaming method according to claim 44, wherein the gaming method and skill game are implemented in a United States federally regulated gaming device in which player skill influences game outcome.

55. The skill game according to claim 44, wherein the skill game is a game that would not have been subject to Class III gaming regulations in the United States on Apr. 19, 2002.

56. A skill game, comprising:

a gaming device configured to implement the skill game;

a buy-in mechanism configured to accept a buy-in for play of the skill; and an award mechanism configured to randomly select a prize to be awarded by the gaming module upon a successful completion of the skill game;

wherein the gaming device is further configured to accept player input that alters at least one parameter of the skill game and change the award.

57. The skill game according to claim 56, wherein the player input comprises a request to buy-in to an award pool.

58. The skill game according to claim 56, wherein:

the player input comprises a request for a hint pertaining to successful completion of the skill game; and the change in award is a reduction in value of the award.

59. The skill game according to claim 56, wherein a value of the award is reduced during implementation of the skill game.

60. The skill game according to claim 56, further comprising a timer configured to allow a player a predetermined amount of time to complete the skill game.

61. A skill game, comprising:

a gaming module configured to play the skill game;

a game purchase device configured to accept a buy-in for play of the skill game and notify the gaming module of acceptance of the buy-in; and an award mechanism configured to randomly select a prize to be awarded upon successful completion of the skill game;

wherein the prize is randomly selected by the award mechanism after acceptance of the wager.

62. The skill game according to claim 61, wherein successful completion of the skill game is determined primarily by a level of skill of a player.

63. The skill game according to claim 61, wherein a predetermined portion of a player buy-in is deducted for a management fee.

64. A skill game comprising:

a game device configured to play a skill game and randomly select a prize to be awarded upon successful completion of the skill game;

wherein the game device notifies a player of the randomly selected award after starting the skill game and prior to completion of the skill game.

65. The skill game according to claim 64, wherein the prize is a purse that may be increased in value based upon inputs to the game device.

66. The skill game according to claim 64, wherein the prize is a purse that is reduced in value based on options selected during game play.

67. A skill game, comprising:

a gaming means for playing a skill game;

a purchase means for receiving value from a player prior to playing the skill game; and a prize means for selecting an award for successful completion of the skill game;

wherein the prize means randomly selects the award after receipt of the value by the purchase means.

68. The skill game according to claim 67, further comprising adjustment means for adjusting a value of the award after start of the skill game.

69. The skill game according to claim 68, wherein the adjustment means decreases the award value upon selection of a hint by the player.

70. The skill game according to claim 68, wherein the adjustment means increases the award value upon completion of a buy-in option by the player.

71. The skill game according to claim 70, wherein the buy-in option comprises a randomly selected portion of a buy-in pool.

72. The skill game according to claim 70, wherein the buy-in option is made available by the gaming means if the buy-in pool is above a predetermined level.

73. A skill game, comprising:

a machine configured to accept a buy-in to the skill game and play the skill game with a player;

a randomized award generation device configured to produce a random award value after acceptance of the buy-in;

wherein:

the machine is further configured to award the award value to the player only when the player successfully completes the skill game.

74. The skill game according to claim 73, wherein the skill game includes a time-out period after which the game is ended and the player cannot successfully complete the skill game.

75. The skill game according to claim 73, wherein the random award is generated from an award pool.

76. The skill game according to claim 75, wherein a level of skill required to complete the skill game is adjusted based on an amount of award returned to players of the skill game.

77. A skill game, comprising:

a machine configured to accept a buy-in to the skill game and play the skill game with a player;

a randomized award generation device configured to produce a random award value after acceptance of the buy-in;

wherein:

the machine is further configured to award the award value to the player only when the player successfully completes the skill game; and the machine is yet further configured to reduce the random award value based on player selections during play of the skill game.

78. The skill game according to claim 77, wherein the player selections include at least one of buying a hint and buying additional time to complete the skill game.

* * * * *